US008919545B2

(12) United States Patent
Chang

(10) Patent No.: US 8,919,545 B2
(45) Date of Patent: Dec. 30, 2014

(54) DESICCATING CONTAINER

(75) Inventor: Yi Ming Chang, Taichung County (TW)

(73) Assignee: Bionime Corporation (TW)

( * ) Notice: Subject to any disclaimer, the term of this patent is extended or adjusted under 35 U.S.C. 154(b) by 310 days.

(21) Appl. No.: 13/152,688

(22) Filed: Jun. 3, 2011

(65) Prior Publication Data

US 2012/0193246 A1 Aug. 2, 2012

(30) Foreign Application Priority Data

Jan. 28, 2011 (TW) ..... 100202149 U

(51) Int. Cl.

| | |
|---|---|
| ***B65D 81/26*** | (2006.01) |
| ***F17C 11/00*** | (2006.01) |
| ***B65D 43/16*** | (2006.01) |
| ***B65D 51/24*** | (2006.01) |
| ***B65D 77/04*** | (2006.01) |

(52) U.S. Cl.

CPC ..... *B65D 81/266* (2013.01); *B65D 43/162* (2013.01); *B65D 51/245* (2013.01); *B65D 77/0493* (2013.01); *B65D 2543/00092* (2013.01); *B65D 2543/00296* (2013.01); *B65D 2543/00537* (2013.01); *B65D 2543/00629* (2013.01); *B65D 2543/00685* (2013.01); *B65D 2543/00842* (2013.01)

USPC ..... 206/204

(58) Field of Classification Search

USPC ..... 206/204, 540, 501, 499, 546, 223, 216, 206/217, 528, 445, 509, 514; 222/187; 220/23.9, 23.91

See application file for complete search history.

(56) References Cited

U.S. PATENT DOCUMENTS

| | | | | |
|---|---|---|---|---|
| 1,480,827 | A * | 1/1924 | McColl | 220/592.14 |
| 5,911,937 | A | 6/1999 | Hekal | |
| 2005/0150804 | A1* | 7/2005 | Chen | 206/514 |
| 2010/0140116 | A1* | 6/2010 | Stiene et al. | 206/204 |
| 2011/0056951 | A1* | 3/2011 | Wooldridge | 220/495.01 |
| 2011/0127176 | A1* | 6/2011 | Chang et al. | 206/204 |

FOREIGN PATENT DOCUMENTS

WO 2008092639 A1 8/2008

* cited by examiner

*Primary Examiner* — Bryon Gehman
*Assistant Examiner* — Rafael Ortiz
(74) *Attorney, Agent, or Firm* — Volpe and Koenig, P.C.

(57) ABSTRACT

A desiccating container is provided in the present invention. The desiccating container includes an outer can having a cap; a first inner can having an outer side and configured in the outer can, wherein there is a gap provided between the outer can and the first inner can; and a second inner can circularly configured in the outer side and in the gap, and dividing the gap into an inner gap and an outer gap, wherein the first inner can is one of an insert and a desiccating element, and the second inner can is the other one thereof.

10 Claims, 7 Drawing Sheets

DESICCATING CONTAINER

FIELD OF THE INVENTION

The present invention relates to a container, in particular to a container having moisture-absorbing or desiccating function.

BACKGROUND OF THE INVENTION

In order to preserve test strips, pills, capsules or drugs for a long-term period, these items are usually reserved in an air-sealed container, so as to prevent from being moisturized and maintain the quality thereof. Currently, there are various air-sealed devices, including the mentioned air-sealed based container, a vacuum based container and an air-sealed container having desiccating function, provided over the market.

For the air-sealed container having desiccating function, in particular a desiccating container that is assembled in a configuration of an inner can and outer can, such container usually utilizes a gap existing between the inner can and outer can to deposit desiccants. The moisture in the inner can is directly absorbed by the desiccants through the vias opened on the inner can body. The related prior arts are provided as follows, e.g.: PCT Patent No.: WO 2008/092639 and U.S. Pat. No. 5,911,937.

Please refer to FIG. 1(*a*), which is a schematic diagram illustrating a representative figure for PCT Patent No.: WO 2008/092639. A container 101 for preserving a moisture sensitive test element is disclosed in FIG. 1. The container 101 includes a can body 102 and an insert 122 placed in the can body 102. A gap between an outer surface of the side wall 124 of the insert 122 and an inner surface of side wall 104 of can body 102 is defined as a cavity 118. There are multiple desiccants placed in the cavity 118. Furthermore, there is a lid 150 disposed at the opening of the can body 102. The lid 150 is utilized to seal the opening of the can body 102. There is a hollow channel 129 in the insert 122 for preserving the moisture sensitive test elements. The desiccants placed in the cavity 118 can directly contact with the moisture in the hollow channel 129 through the vias opened on the insert 122.

Please refer to FIGS. 1(*b*) and 1(*c*), which are the schematic diagrams illustrating the representative figures for U.S. Pat. No. 5,911,937. The container 61 disclosed in FIG. 1(*c*) has a desiccant entrained plastic layer 20 disposed on the inner surface 65 of the container 61. The layer 20 is formed by entraining the desiccating agent 30 and the channeling agent 35 into the polymer 55. The channeling agent 35 can form a plurality of passages (not shown in FIGS. 1(*b*) and 1(*c*)) in the polymer 55 to enable the desiccants 35 communicating with extrinsic space, whereby the desiccants 35 entrained into the polymer 25 can absorb the moisture in the container 61. The desiccant entrained plastic layer 20 can also be directly formed on the inner surface 65 of the container 61 by an integrated molding or an in-mold technology become a part of the inner surface 65, as shown in FIG. 1(*c*).

However, the above-mentioned descanting container utilizing the gap between the outer can and the inner can to place the desiccants has some disadvantages as follows. For such container, the desiccants are placed in the gap and usually absorb the moisture in the inner can through the vias opened on the inner can body. Thus the desiccants can only utilize a single side (the side toward the vias), one of the two principle sides thereof, to absorb the moisture. Such configuration for the desiccating container certainly results in a poor usability efficiency. Furthermore, under such configuration, the gap requires a relatively large size to contain enough desiccants for providing sufficient moisture-absorbing efficacy, which leads the effective containing space in the inner can to be reduced.

Hence, regardless of the aspect of the structure or the usability, the current desiccating container still possesses many defects due to the aforementioned unperfected design, which might influences the preservation of the test strips, pills, capsules or drugs at the same time. Thus the desiccating container still demands to be innovated and improved. Accordingly, in view of the drawbacks in the prior art, a novel desiccating container is thus provided. The unique configuration for the novel desiccating container in the present invention can not only Solve the problems described above but is also easy to be implemented. Thus, the invention has the utility for the industry.

SUMMARY OF THE INVENTION

The desiccating container provided by the present invention has a structure characterized in that, for a desiccating container including an outer can and an insert, a desiccant to be manufactured in a shape approximately conformal with the insert, in particular a molecular sieve desiccant or a desiccating agents entrained plastic desiccant, is circularly configured outside the insert, or alternatively, the insert is circularly configured outside the desiccant. Therefore, there is a gap provided between the outer can and the desiccant or the insert. However, the gap will be divided into an outer gap and an inner gap by the desiccant or the insert, depending on which one of the desiccant and the insert is situated adjacent to the outer can.

For example, while the desiccant is circularly configured outside the insert, namely between the outer can and the insert, the moisture, humidity or wet in the containing space of the insert can freely flow between the outer and inner gaps, such that the desiccant is capable of absorbing the moisture, humidity or wet by its two principle sides, an outer side toward the outer can and an inner side toward the insert.

In such configuration, two principle sides of the desiccant can be fully utilized for absorbing moisture, so as to achieve a dual-side moisture absorbing efficacy and increase the utility efficiency for the desiccant. At the same time, since the desiccant has been manufactured as a cylindrical thin plate, the size of the gap is significantly increased and the containing space in the insert is decreased accordingly.

The desiccating container in accordance with the present invention is preferably suitable for reserving strips, pills, capsules, drugs or moist-proof requiring small articles, in particular test strips, such as glucose testing strips or diabetes testing strips, for a long time.

In accordance with the first aspect of the present invention, a desiccating container is provided. The desiccating container includes an outer can having a cap; a first inner can having an outer side and configured in the outer can, wherein there is a gap provided between the outer can and the first inner can; and a second inner can circularly configured in the outer side and in the gap, and dividing the gap into an inner gap and an outer gap, wherein the first inner can is one of an insert and a desiccating element, and the second inner can is the other one thereof.

In accordance with the second aspect of the present invention, a desiccating container is provided. The desiccating container includes an outer can having a cover; a first inner can being one of an insert and a desiccating element, having a containing space therein and configured in the outer can, wherein there is a gap provided between the first inner can and the outer can; and a second inner can being the other one of the insert and the desiccating element, circularly configured outside the first inner can wherein the second inner can corresponds to the gap and keeps a distance from the outer can.

Other objects, advantages and efficacy of the present invention will be described in detail below taken from the preferred embodiments with reference to the accompanying drawings, in which:

BRIEF DESCRIPTION OF THE DRAWINGS

FIGS. 1(*b*) and 1(*c*) are the schematic diagrams illustrating the representative figures for U.S. Pat. No. 5,911,937.

DETAILED DESCRIPTION OF THE PREFERRED EMBODIMENT

Figure 1A:
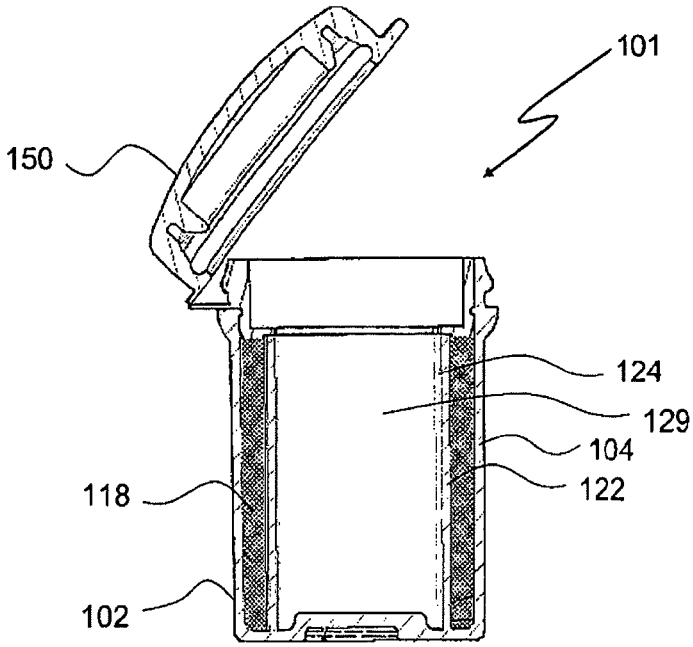
FIG. 1(*a*) is the schematic diagram illustrating a representative figure for PCT Patent No.: WO 2008/092639.
Figure 1B:
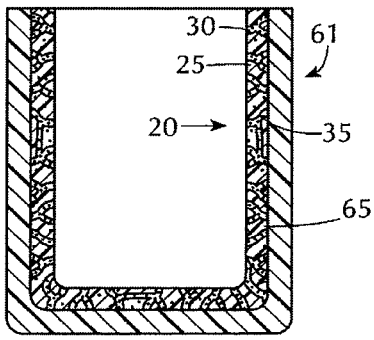
Figure 1C:
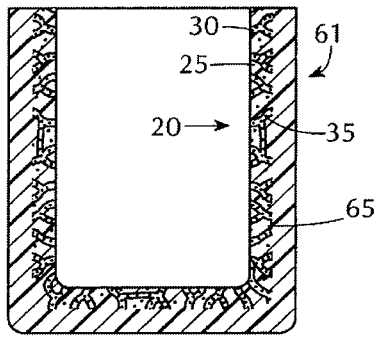

The present invention will now be described more specifically to the following embodiments. However, it is to be noted that the following descriptions of preferred embodiments of this invention are presented herein for the purposes of illustration and description only; it is not intended to be exhaustive or to be limited to the precise form disclosed.

Moreover, in order to provide clearer descriptions to facilitate easily understanding of the present invention, the parts of the drawing do not draw in accordance with their relative sizes. Some sizes and scales have been exaggerated. The parts of unrelated details are not drawn completely to simplify the drawing.

Figure 2:
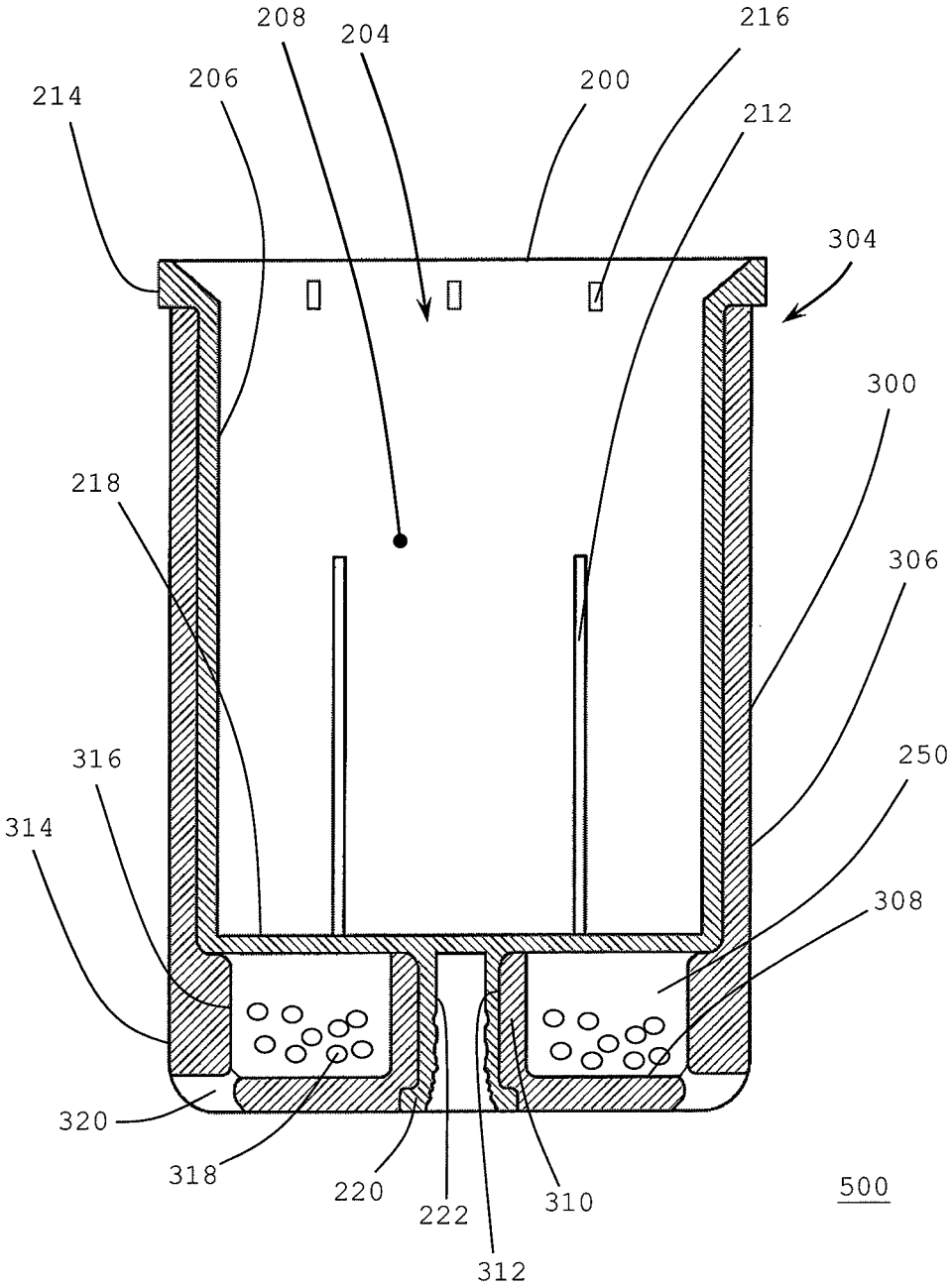
FIG. 2 is the schematic diagram illustrating a first embodiment for the insert and the desiccant element in accordance with the present invention.

Please refer to FIG. 2, which is the schematic diagram illustrating a first embodiment for the insert and the desiccant element in accordance with the present invention. The insert 200 in FIG. 2 is a first cylindrical tank 206 having containing space 208 therein and the opening 204 at one end thereof. The bulk in the first cylindrical tank 206 is the containing space 208 that the insert 200 has. A primary storing space for the desiccating container consists of the containing space 208 and is utilized for reserving, for example, test strips, pills, capsules, drugs or moist-proof requiring articles. There are a plurality of body apertures 212 opened on the body of the first cylindrical tank 206. The insert has a boundary outwardly protruded for forming a lip-like edge 214 at the opening 204. There are also a plurality of edge apertures 216 opened on the lip-like edge 214. The insert 200 has a first bottom 218 having an outer surface, a surface toward a direction opposite to the containing space 208. There is a first tenon base 220 disposed on the outer surface of the first bottom 218. The first tenon base 220 has a first cylindrical groove 222 for providing the first tenon 412 (please refer to FIG. 4) disposed on the third bottom 410 of the outer can 400 to be correspondingly embedded thereinto, so as to fix the insert 200 inside the outer can 400.

The desiccant element 300 is a second cylindrical tank 306 manufactured in a shape approximately conformal with the insert 200 and having the opening 304 at one end thereof. The desiccant element 300 is preferably made of a molecular sieve desiccant by an injection-molding technology. The first cylindrical tank 206 of the insert 200 has a diameter smaller than a diameter of the second cylindrical tank 306 of the desiccant element 300. Thus the insert 200 is capable of insetting or plugging into the desiccant element 300, that is to say, the first cylindrical tank 206 can inset or plug into the second cylindrical tank 306. Most of the inset insert 200 is encompassed by the desiccant element 300 except the lip-like edge 214 at opening 204. The lip-like edge 214 of the inset insert 200 is protruded from the body of the insert 200 and has a width larger than a thickness that the desiccant element 300 has, such that the lip-like edge 214 can contact with the body of the outer can 400 (please refer to FIG. 4), so as to separate the outer can 400 from the insert 200 to define a gap between the outer can 400 and the insert 200.

Figure 3:
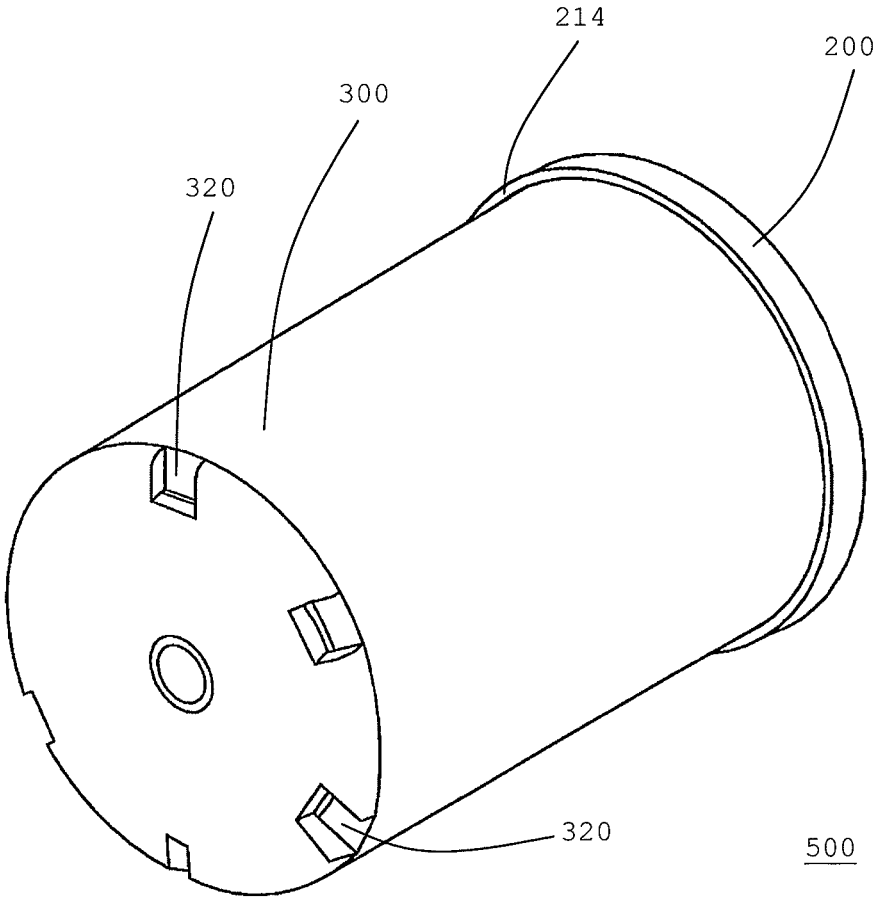
FIG. 3 is the schematic diagram illustrating a first assembly of the insert and the desiccant element in accordance with the present invention.

The desiccant element 300 has a second bottom 308 having an inner surface, a surface toward the containing space 208. There are a plurality of bottom apertures 320 opened on the second bottom 308 and there is a second tenon base 310 disposed on the inner surface of the second bottom 308. The second tenon base 310 has a second cylindrical groove 312 for providing the first tenon base 220 disposed on the insert 200 to be correspondingly embedded thereinto, so as to fix the desiccant element 300 in a position relative to the insert 200. While the insert 200 is inset or plugged into the desiccant element 300 to form a first assembly 500, as shown in FIGS. 2 and 3, the first assembly 500 is capable of being correspondingly inset or plugged into the outer can 400 by embedding the first tenon 412 into the first tenon base 220.

In addition, the desiccant element 300 has a side wall with thickness. The thickness of the side wall near the second bottom 308, preferably the thickness of the side wall existing between the second bottom 308 corresponding to the distal end of the second tenon base 310, is increased, so as to form a barrier height 316. While the insert 200 is inset or plugged into the desiccant element 300, a reserved space 250 is accordingly formed between the first bottom 218 of the insert 200 and the second bottom 308 of the desiccant element 300, for further containing more moisture-absorbing material 318. The desiccating element 300 is preferably a desiccant entrained macromolecular polymer, a moisture-absorbing material based desiccant, a water-absorbing material based desiccant, a molecular sieve desiccant, a desiccant entrained plastic and a cylindrical desiccant.

Figure 4:
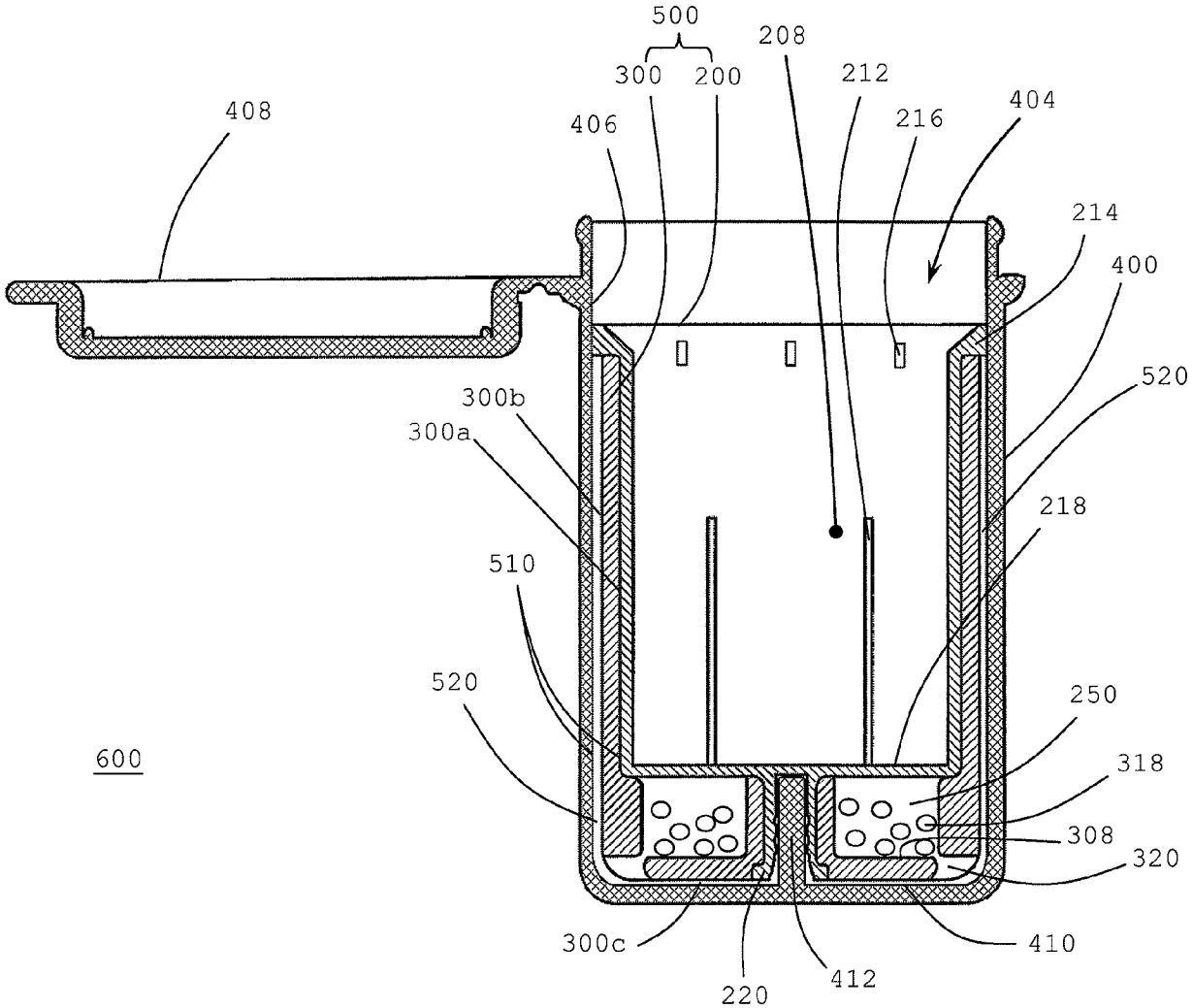
FIG. 4 is the schematic diagram illustrating a first embodiment for the insert, the desiccant element and the outer can in accordance with the present invention.

Please refer to FIG. 4, which is the schematic diagram illustrating a first embodiment for the insert, the desiccant element and the outer can in accordance with the present invention. The outer can 400 in FIG. 4 is a third cylindrical tank 406 having the opening 404 at one end thereof. There is a cap 408 disposed at the opening 404 for closing the opening 404 of the outer can 400. There is a first tenon 412 disposed on the inner surface, which is directed toward the containing space 208, of the third bottom 410 of the outer can 400. The first tenon 412 is corresponded to the first tenon base 220 on the first bottom 218 of the insert 200 in space and can be embedded into the first tenon base 220, such that the assemble 500 of the insert 200 and the desiccant element 300 can be fixed in the outer can 400.

The outer can 400 is closed by the cap 408, such that the outer can 400 is equipped with outstanding air-sealing performance, relatively higher pressure resistibility, better desiccating capability and prominent long-duration preservation capability, which can well keep articles stored in the containing space dry and therefore ensure the safety and stability for the articles. More technical contents with respect to the outer can 400 with the cap 408 are disclosed in U.S. patent application Ser. No. 12/793,769, which is incorporated by reference as if fully set forth herein.

Figure 5B:
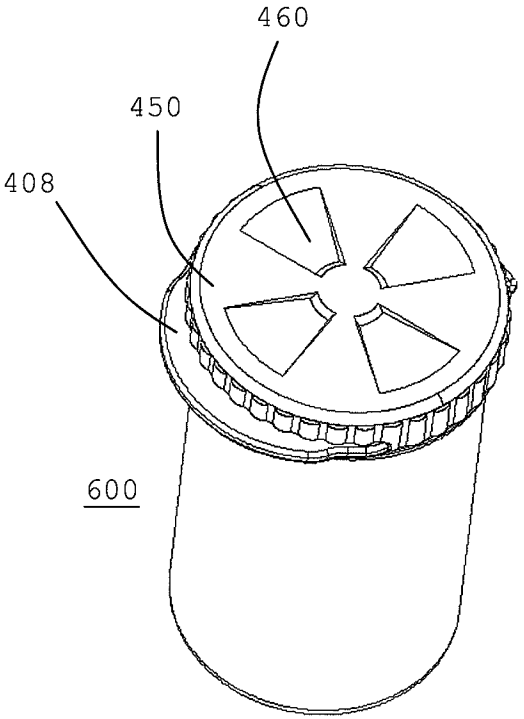
FIGS. 5(*a*) and 5(*b*) are the schematic diagrams illustrating the identification pattern on the cap in accordance with the present invention.
Figure 5A:
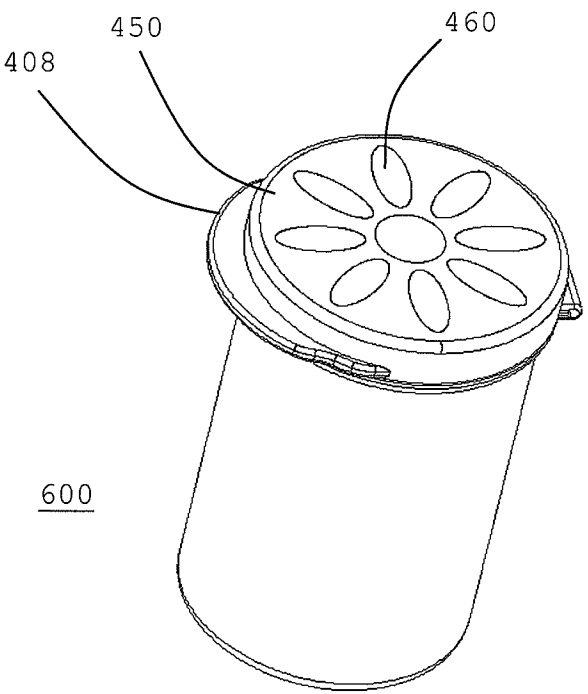

Furthermore, in order to enable that users can easily recognize which kind of object is stored in the containing space according to the extrinsic appearance of desiccating container 600, there is an identification pattern 460 selectively formed on the outer surface 450 of the cap 408, as shown in FIGS. 5(*a*) and 5(*b*). The identification pattern 460 is preferably a solid identification pattern with rough and uneven surface or a color identification pattern with visual graphic design. The solid identification pattern is provided to be used by a blind or sightless person or can be utilized by a common person in a relatively darker environment to distinguish different articles stored in the desiccant container just dependent upon tactile sense to the solid identification pattern.

Please keep referring to FIG. 4. While the desiccant element 300 is assembled into the insert 200 to form the first assemble 500, the first assemble 500 can be connected with the outer can 400 by embedding the first tenon 412 on the third bottom 410 of the outer can 400 into the first tenon base 220 on the first assemble 500 to form the desiccating container 600, i.e. a second assemble, as shown in FIG. 4.

The desiccating container 600 in FIG. 4 includes the insert 200, the desiccant element 300 and the outer can 400. The containing space 208 in the desiccating container 600 is used for preserving strips, pills, capsules, drugs or moist-proof requiring articles. The lip-like edge 214 on the insert 200 can contact with the body of outer can 400 in that the lip-like edge 214 has a width larger than a thickness of the desiccant element 300, whereby the gap 510 is defined between the outer can 400 and the insert 200. The desiccant element 300 is well fixed with the insert 200 by the couple of the first tenon base 220 and the second tenon base 310. The desiccant element 300 encompasses the insert 200 and is situated in the gap 510. It is noticed that the desiccant element 300 is corresponded to the gap and does not directly contact with the outer can 400, so that there is a distance left between the desiccant element 300 and the outer can 400 and an air gap 520 is thus formed therebetween. The air gap 520 is extended along the outer surface 300*b* of the desiccant element 300 toward the bottom surface 300*c* of the desiccant element 300.

To briefly sum up, in the present first embodiment, the desiccant element 300 has the inner surface 300*a*, the outer surface 300*b* and the bottom surface 300*c*. The inner surface 300*a* can absorb the moisture, humidity or the wet in the containing space 208 through the body aperture 212 on the insert 200. The outer surface 300*b* and the bottom surface 300*c* are connected with the containing space 208 through the edge apertures 216 on the insert 200 and can absorb the moisture, humidity or the wet in the containing space 208 through the air gap 520 and the edge apertures 216. Therefore, the desiccant element 300 can exert and achieve a dual-side moisture absorbing efficacy.

The reserved space 250 formed between the insert 200 and the desiccant element 300 is connected with the containing space 208 through the air gap 520 and the bottom aperture 320 on the desiccant element 300, and the moisture-absorbing material 318 in the reserved space 250 can absorb the moisture, humidity or the wet in the containing space 208 through the air gap 520 and the bottom aperture 320. Under such assistance by the moisture-absorbing material 318 in the reserved space 250, the overall performance for the desiccant container 600 is significantly increased accordingly.

It is noticed that, the insert 200 is used as a first inner can and the desiccant element 300 is used as a second inner can in the above-mentioned first embodiment; however, the first inner can and the second inner can are interchangeable with each other. That is to say, in the first embodiment, the first inner can is the insert 200 and the second inner can is the desiccant element 300. However, a second embodiment can be accordingly derived on the basis of the first embodiment. Simply, in the second embodiment, the first inner can is manufactured as the desiccant element 300 and the second inner can is manufactured as the insert 200.

Figure 6:
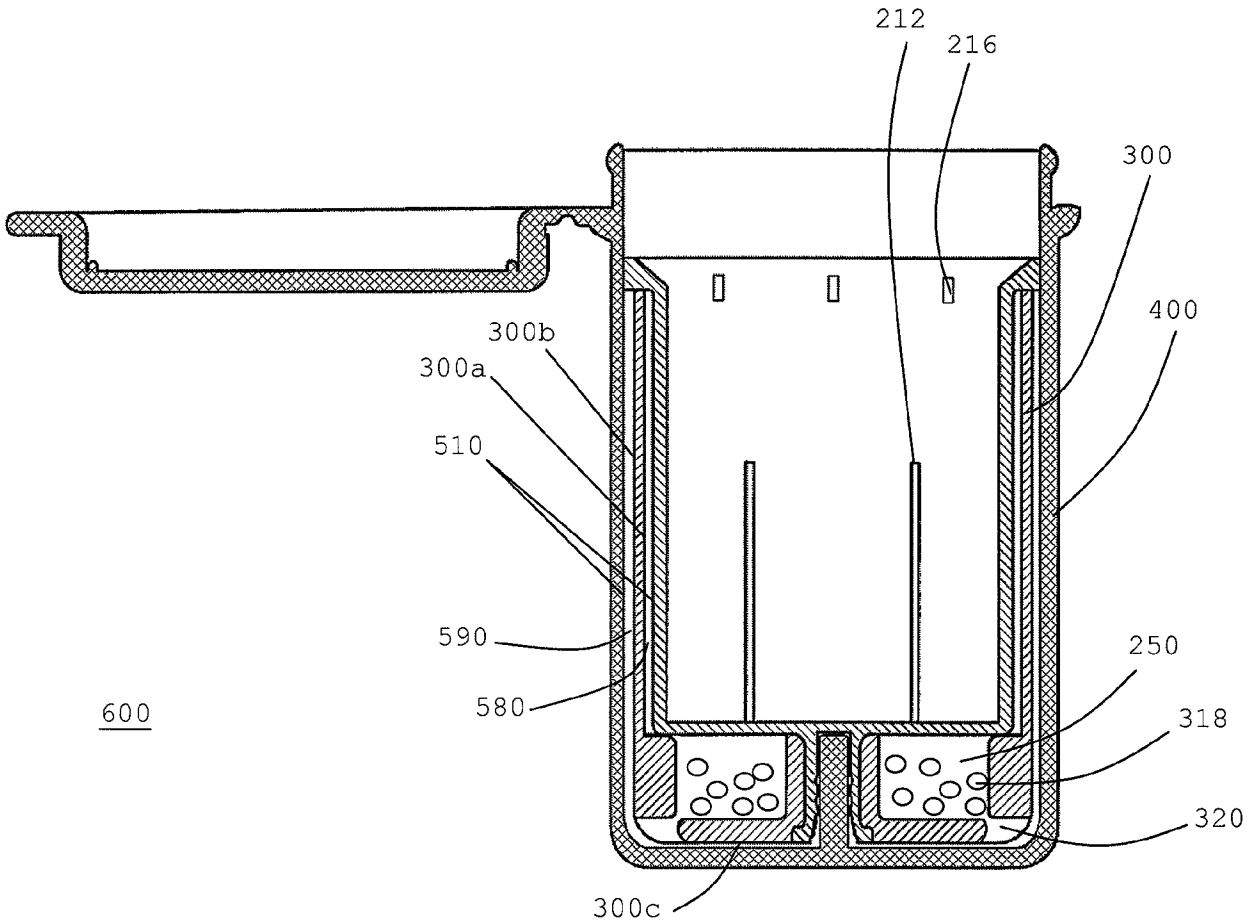
FIG. 6 is the schematic diagram illustrating a third embodiment for the insert and the desiccant element in accordance with the present invention.

Please refer to FIG. 6, which is the schematic diagram illustrating a third embodiment for the insert and the desiccant element in accordance with the present invention. The third embodiment is based on the first embodiment and has the reference numerals identical with those in the first embodiment for the same element. The difference between the third embodiment and the first embodiment is that: the desiccant element 300 between the insert 200 and the outer can 400 and contained in the gap 510 is circularly configured outside the insert but does not contact with the outer side of the insert 200, so as to divide the gap 510 into an inner gap 580 and an outer gap 590 (namely the air gap 510 in the first embodiment), wherein the outer gap 590 is extended along the outer surface 300*b* of the desiccant element 300 toward the bottom surface 300*c* of the desiccant element 300.

Since the moisture, humidity or wet in the containing space 208 flows between the inner gap 580 and the outer gap 590, the desiccant element 300, in particular the outer surface 300*b* and the bottom surface 300*c* thereof, can absorb the moisture, humidity or wet in the containing space 208 through the path defined by outer gap 590 and the edge apertures 216, and to the inner surface 300*a*, can absorb the moisture, humidity or wet in the containing space 208 through the path defined by the inner gap 580 and the body apertures 212. The moisture-absorbing material 318 in the reserved space 250 can absorb the moisture, humidity or wet in the containing space 208 through the path defined by the bottom apertures 320 and the outer gap 590. In such third embodiment, the inner surface 310*a* of the desiccant element 300 can be fully utilized to absorb moisture, humidity or wet, due to the configuration of the inner gap 580.

In brief, since the desiccant element 300 divides the gap 510 into inner gap 580 and the outer gap 590, the moisture, humidity or wet flows through the inner gap 580 and the outer gap 590 can be relatively better absorbed by the dual sides, the inner surface 300*a* and the outer surface 300*b* on the desiccant element 300, and by the moisture-absorbing material 318 in the reserved space 250.

It is noticed that, the inert 200 is used as a first inner can and the desiccant element 300 is used as a second inner can in the above-mentioned third embodiment; however, the first inner can and the second inner can are interchangeable with each other. That is to say, in the third embodiment, the first inner can is the insert 200 and the second inner can is the desiccant element 300. However, a fourth embodiment can be accordingly derived on the basis of the third embodiment. Simply, in the fourth embodiment, the first inner can is manufactured as the desiccant element 300 and the second inner can is manufactured as the insert 200.

Figure 7:
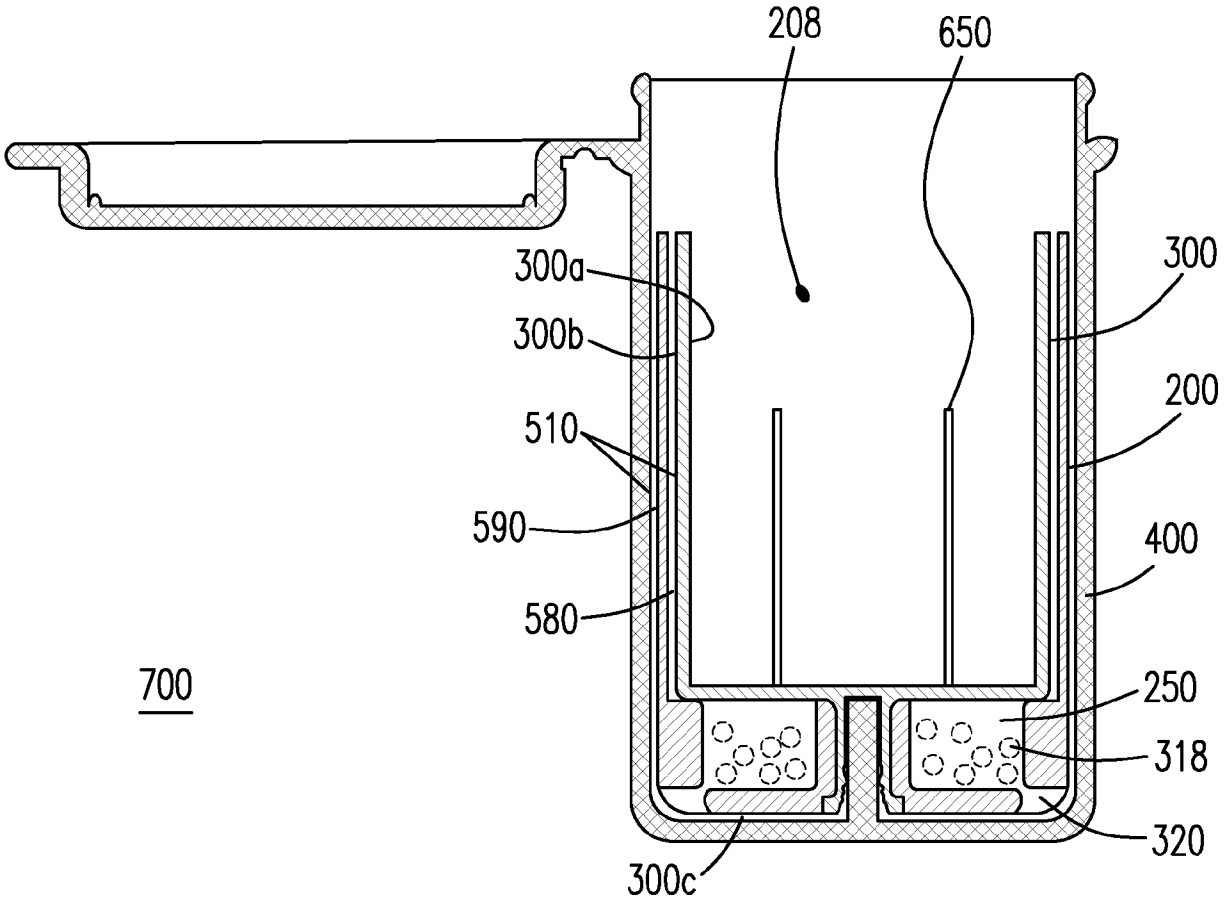
FIG. 7 is the schematic diagram illustrating a fourth embodiment for the insert and the desiccant element in accordance with the present invention.

Please refer to FIG. 7, which is the schematic diagram illustrating a fourth embodiment for the insert and the desiccant element in accordance with the present invention. The insert 200 of the desiccating container 700 in the FIG. 7 is circularly configured outside the desiccant element 300 and the insert 200 and the desiccant element 300 are fixed in the outer can 400. The desiccant element 300 divides the gap 510 into inner gap 580 and the outer gap 590 (namely the air gap 510 in the first embodiment). The desiccant element 300 does not dispose with a lip-like edge outwardly protruded at the opening end and edge apertures like other embodiments. Therefore, the containing space 208, inner gap 580, the outer gap 590 and the reserved space 250 are all connected with each other, and thus the moisture, humidity or wet in the containing space 208 can smoothly and freely flow thereamong to be absorbed by the multiple sides of the desiccant element 300.

The moisture, humidity or wet in the containing space 208 can be directly absorbed by the inner surface 300*a* of the desiccant element 300 or flows to the inner gap 580 through the aperture 650 on the desiccant element 300 to be absorbed by the outer surface 300*b* and the bottom surface 300*c* of the desiccant element 300. The moisture-absorbing material 318 in the reserved space 250 can absorb the moisture, humidity or wet in the containing space 208 through the bottom apertures 320 and the outer gap 590. In such fourth embodiment, the multiple sides of the desiccant element 300 including the inner surface 300*a*, outer surface 300*b* and the bottom surface 300*c* can be fully utilized to absorb moisture, humidity or wet.

Furthermore, there are still several paths formed in the third embodiment as follows including a first path, through which a moisture, humidity or wet in the containing space freely flows, defined by the containing space 208, and the respective edge apertures 216 to the outer gap 590 and the inner gap 580, a second path, through which a moisture, humidity or wet in the containing space freely flows, defined by the containing space 208, the respective body apertures 212 and the inner gap 580, a third path, through which a moisture, humidity or wet in the containing space freely flows, defined by the containing space 208, the respective edge apertures 216, the outer gap 590, the respective base apertures and the reserved space 250, and a fourth path, through which a moisture, humidity or wet in the containing space freely flows, defined by the containing space 208, the respective bottom apertures 320 and the reserved space 250.

EMBODIMENTS

Embodiment 1

A desiccating container includes an outer can having a cap; a first inner can having an outer side and configured in the outer can, wherein there is a gap provided between the outer can and the first inner can; and a second inner can circularly configured in the outer side and in the gap, and dividing the gap into an inner gap and an outer gap, wherein the first inner can is one of an insert and a desiccating element, and the second inner can is the other one thereof.

Embodiment 2

The desiccating container according to Embodiment 1, wherein the first inner can includes a first bottom having an outer surface with a tenon base disposed thereon, the outer can includes a third bottom having an inner surface with a tenon disposed thereon, protruded therefrom and corresponding to the tenon base in position, and the tenon is configured to be inserted into the tenon base so as to fix the first inner can inside the outer can.

Embodiment 3

The desiccating container according to Embodiment 2, wherein the first inner can has a containing space and a first opening at one end thereof, the first opening has a boundary protruded outwardly for forming a lip-like edge contacting with the outer can, the second inner can has a second bottom and a second opening at one end thereof, and there is a reserved space formed between the first bottom and the second bottom for containing a moisture-absorbing material.

Embodiment 4

The desiccating container according to Embodiment 3, wherein the first inner can has a body with a plurality of body apertures formed thereon for allowing air between the containing space and the inner gap to communicate with each other, the boundary has a plurality of edge apertures formed thereon for allowing air among the containing space, the inner gap and the outer gap to communicate with one another, the first bottom has a plurality of base apertures formed thereon for allowing air between the reserved space and the containing space to communicate with each other and the second bottom has a plurality of bottom apertures formed thereon for allowing air between the outer gap and the reserved space to communicate with each other.

Embodiment 5

The desiccating container according to Embodiment 3, wherein the second inner can has an outer surface, the outer gap is extended along the outer surface of the second inner can toward the second bottom, and the inner gap is extended along the outer surface of the first inner can toward the first bottom.

Embodiment 6

The desiccating container according to Embodiment 5, wherein there is a first path, through which a moisture in the containing space freely flows, defined by the containing space, and the respective edge apertures to the outer gap and the inner gap, a second path, through which the moisture in the containing space freely flows, defined by the containing space, the respective body apertures and the inner gap, a third path, through which the moisture in the containing space freely flows, defined by the containing space, the respective edge apertures, the outer gap, the respective base apertures and the reserved space, and a fourth path, through which the moisture in the containing space freely flows, defined by the containing space, the respective bottom apertures and the reserved space.

Embodiment 7

The desiccating container according to Embodiment 6, wherein the moisture in the containing space contacts with and is absorbed by the second inner can via the first and second paths, and the moisture in the containing space contacts with and is absorbed by the moisture-absorbing material via the third and fourth paths, while the second inner can is the desiccating element.

Embodiment 8

The desiccating container according to Embodiment 6, wherein the moisture in the containing space directly contacts with and is absorbed by the first inner can, while the first inner can is the desiccating element.

Embodiment 9

The desiccating container according to Embodiment 1, wherein the desiccating element is one selected from a group consisting of a desiccant entrained macromolecular polymer, a moisture-absorbing material based desiccant, a water-absorbing material based desiccant, a molecular sieve desiccant, a desiccant entrained plastic and a cylindrical desiccant.

Embodiment 10

The desiccating container according to Embodiment 1, wherein the cap has an outer surface and an identification pattern on the outer surface.

Embodiment 11

A desiccating container includes an outer can having a cover; a first inner can being one of an insert and a desiccating element, having a containing space therein and configured in the outer can, wherein there is a gap provided between the first inner can and the outer can; and a second inner can being the other one of the insert and the desiccating element, circularly configured outside the first inner can wherein the second inner can corresponds to the gap and keeps a distance from the outer can.

Embodiment 12

The desiccating container according to Embodiment 11, wherein the first inner can includes a first bottom having an outer surface with a tenon base disposed thereon, the outer can includes a third bottom having an inner surface with a tenon disposed thereon, protruded therefrom and corresponding to the tenon base, and the tenon is operated to be inserted into the tenon base so as to fix the first inner can inside the outer can.

Embodiment 13

The desiccating container according to Embodiment 12, wherein the first inner can has a containing space and a first opening at one end thereof, the first opening has a boundary protruded outwardly for forming a lip-like edge contacting with the outer can, the second inner can has a second bottom and a second opening at one end thereof, and there is a reserved space formed between the first bottom and the second bottom for containing a moisture-absorbing material.

Embodiment 14

The desiccating container according to Embodiment 13, wherein the first inner can has a body with a plurality of body apertures formed thereon, the boundary has a plurality of edge apertures formed thereon, the first bottom has a plurality of base apertures formed thereon, and the second bottom has a plurality of bottom apertures formed thereon.

Embodiment 15

The desiccating container according to Embodiment 14, wherein the second inner can has an outer surface, the outer gap is extended along the outer surface of the second inner can toward the second bottom, and the inner gap is extended along the outer surface of the first inner can toward the first bottom.

Embodiment 16

The desiccating container according to Embodiment 15 further includes a first path defined by the containing space, the respective edge apertures to the outer gap and the inner gap; a second path defined by the containing space, the respective body apertures to the inner gap; a third path defined by the containing space, the respective edge apertures, the outer gap, the respective base apertures to the reserved space; and a fourth path defined by the containing space, the respective bottom apertures to the reserved space.

Embodiment 17

The desiccating container according to Embodiment 16, wherein the moisture in the containing space contacts with and is absorbed by the second inner can via the first and second paths, and the moisture in the containing space contacts with and is absorbed by the moisture-absorbing material via the third and fourth paths, while the second inner can is the desiccating element.

Embodiment 18

The desiccating container according to Embodiment 16, wherein the moisture in the containing space directly contacts with and is absorbed by the first inner can, while the first inner can is the desiccating element.

Embodiment 19

The desiccating container according to Embodiment 11, wherein the desiccating element is one selected from a group consisting of a desiccant entrained macromolecular polymer, a moisture-absorbing material based desiccant, a water-absorbing material based desiccant, a molecular sieve desiccant, a desiccant entrained plastic and a cylindrical desiccant.

Embodiment 20

The desiccating container according to Embodiment 11, wherein the cap has an outer surface and an identification pattern on the outer surface.

Based on the above descriptions, while the invention has been described in terms of what are presently considered to be the most practical and preferred embodiments, it is to be understood that the invention should not be limited to the disclosed embodiment. On the contrary, it is intended to cap numerous modifications and variations included within the spirit and scope of the appended claims which are to be accorded with the broadest interpretation so as to encompass all such modifications and variations. Therefore, the above description and illustration should not be taken as limiting the scope of the present invention which is defined by the appended claims.

What is claimed is:

1. A desiccating container, comprising:

an outer can having a cap;

a first inner can having a containing space, a body with a plurality of body apertures formed thereon, a first opening, a lip edge positioned at top of the first inner can and having a lateral surface contacting with the outer can, and having a plurality of edge apertures formed on the lateral surface, a first bottom having a plurality of base apertures formed thereon, a first outer surface and an outer side and configured in the outer can, wherein there is a gap provided between the outer can and the first inner can; and a second inner can circularly configured in the outer side and in the gap, having a second bottom with a plurality of bottom apertures formed thereon, a second outer surface, and a second opening at one end thereof, and dividing the gap into an inner gap and an outer gap, wherein the first inner can is an insert and the second inner can is a desiccating element configured to absorb a moisture in the containing space directly via the plurality of edge apertures, the outer gap is extended from the plurality of edge apertures along the second outer surface and toward the plurality of bottom apertures, and the inner gap is extended from the plurality of body apertures along the first outer surface and toward the first bottom, and there is a reserved space formed between the first bottom and the second bottom for containing a moisture-absorbing material.

2. The desiccating container according to claim 1, wherein the first outer surface has a tenon base disposed thereon, the outer can comprises a third bottom having an inner surface with a tenon disposed thereon, protruded therefrom and corresponding to the tenon base in position, and the tenon is configured to be inserted into the tenon base so as to fix the first inner can inside the outer can.

3. The desiccating container according to claim 1, wherein the moisture in the containing space directly contacts with and is absorbed by the first inner can, while the first inner can has an additional desiccating element.

4. The desiccating container according to claim 1, wherein the desiccating element is one selected from a group consisting of a desiccant entrained macromolecular polymer, a moisture-absorbing material based desiccant, a water-absorbing material based desiccant, a molecular sieve desiccant, a desiccant entrained plastic and a cylindrical desiccant.

5. The desiccating container according to claim 1, wherein the cap has an outer surface and an identification pattern on the outer surface.

6. A desiccating container, comprising:

an outer can having a cover;

a first inner can being an insert, having a body with a plurality of body apertures formed thereon, a first opening, a lip edge positioned at top of the first inner can and having a lateral surface contacting with the outer can and having a plurality of edge apertures formed on the lateral surface, a containing space therein, a first bottom having a plurality of base apertures formed thereon and a first outer surface, and configured in the outer can, wherein there is a gap provided between the first inner can and the outer can; and a second inner can being a desiccating element configured to absorb a moisture in the containing space directly via the plurality of edge apertures, having a second bottom including a plurality of bottom apertures formed thereon, a second outer surface, and a second opening at one end thereof, dividing the gap into an inner gap and an outer gap and being circularly configured outside the first inner can, wherein the second inner can corresponds to the gap and keeps a distance from the outer can, the outer gap is extended from the plurality of edge apertures along the second outer surface and toward the plurality of bottom apertures, and the inner gap is extended from the plurality of body apertures along the first outer surface and toward the first bottom, and there is a reserved space formed between the first bottom and the second bottom for containing a moisture-absorbing material.

7. The desiccating container according to claim 6, wherein the first outer surface has a tenon base disposed thereon, the outer can comprises a third bottom having an inner surface with a tenon disposed thereon, protruded therefrom and corresponding to the tenon base, and the tenon is operated to be inserted into the tenon base so as to fix the first inner can inside the outer can.

8. The desiccating container according to claim 6, wherein the moisture in the containing space directly contacts with and is absorbed by the first inner can, while the first inner can has an additional desiccating element.

9. The desiccating container according to claim 6, wherein the desiccating element is one selected from a group consisting of a desiccant entrained macromolecular polymer, a moisture-absorbing material based desiccant, a water-absorbing material based desiccant, a molecular sieve desiccant, a desiccant entrained plastic and a cylindrical desiccant.

10. The desiccating container according to claim 6, wherein the cover has an outer surface and an identification pattern on the outer surface.

* * * * *